US006126003A

United States Patent [19]

Brouard

[11] Patent Number: 6,126,003

[45] Date of Patent: Oct. 3, 2000

[54] TOOL BAG

[76] Inventor: Roger H. Brouard, 34 Fairmead Rd., Darien, Conn. 06820

[21] Appl. No.: 09/368,701

[22] Filed: Aug. 5, 1999

[51] Int. Cl.[7] ..... B65D 85/00

[52] U.S. Cl. ..... 206/372

[58] Field of Search ..... 206/372, 373; 190/109, 111, 112

[56] References Cited

U.S. PATENT DOCUMENTS

| | | | |
|---|---|---|---|
| D. 360,977 | 8/1995 | Katz . | |
| 3,086,572 | 4/1963 | Lubin . | |
| 4,550,828 | 11/1985 | Baldwin et al. | 206/373 |
| 4,738,547 | 4/1988 | Brown . | |
| 4,773,535 | 9/1988 | Cook . | |
| 5,174,447 | 12/1992 | Fleming . | |
| 5,423,404 | 6/1995 | Shaw . | |
| 5,653,337 | 8/1997 | Cirigliano . | |
| 5,797,491 | 8/1998 | Fierek et al. | 206/373 |

OTHER PUBLICATIONS

Duluth Trading Co., Catalog 97131 Copyright 1997.
Duluth Trading Co., Catalog 98972.
Alta Industries Tradesman Series Catalog.
Plano Drawer Systems Toolboxes Brochure.
Plano Hard Bottoms, Saw Bag and Bucket Holsters Brochure.

*Primary Examiner*—Jacob K. Ackun
*Attorney, Agent, or Firm*—Ware, Fressola, Van der Sluys & Adolphson LLP

[57] ABSTRACT

A tool bag comprises a bottom member, central panel member and fabric body portion. The bottom member and central panel member provide a structural support for the fabric body portion. The central panel member has a handle formed thereon enabling the user to easily lift and carry the tool bag. The fabric body portion has a plurality of fabric pocket panels which form pockets for holding workmen tools in a vertical orientation for easy accessibility. The fabric body portion also has a pair of fabric cover panels which enclose the tools within the tool bag. The tools within the tool bag are secured from view, compactly stored in an organized manner and easily carried.

49 Claims, 10 Drawing Sheets

TOOL BAG

BACKGROUND OF THE INVENTION

1. Technical Field

The present invention relates generally to devices for carrying and storing tools and the like. More particularly, it relates to a fabric bag in which workmen tools are easily organized, carried and accessed.

2. Description of the Background Art

There are presently a variety of hand-tool carrying devices on the market. Some companies offer hard plastic tool boxes that have a hinged top and a small removable tray that lifts out to reveal the inner confines of the box for bulk tool storage. Some have small mounted drawers either in the top or the bottom for smaller tools or loose fasteners. These plastic tool boxes store tools horizontally in a manner whereby they usually end up in a disorganized mass in the bulk tool storage area making selection and accessing of the tools somewhat difficult leading to frustration and sometimes injury. Since these boxes are made of hard plastic or rubber, they often do not conform to unique storage situations in real life trade applications. For a tradesman, storage in a vehicle is critical and sometimes a specific space for a rectangular hard box is not available. Some pick-up trucks have storage space behind the seats that do not lend itself to a rectangular box shape. Additionally, the surface of these boxes is slick and the boxes will quickly slide around if not properly wedged or packed tightly for security.

Another product recently introduced on the market is a "soft" or synthetic fabric bag which is available in different sizes and configurations. Some of these are very similar to a doctor's bag with a zippered opening providing access to an inside cavity where tools lay horizontally. There are some inner pockets but access thereto can be restricted by a full tool load. Outer pockets are provided for small or short tools. These synthetic fabric bags offer an improvement to the plastic boxes as they help protect tools and allow for better and more secure storage of the tools. But the horizontal tool storage layout still presents a problem. Furthermore, the small inaccessible pockets on the inside and small pockets on the outside make these bags somewhat inadequate for hand-tool storage.

Another soft tool storage bag is the "Bucket Boss", which is a bag designed to fit over and inside an empty 5-gallon plastic bucket. It has a variety of pockets on the inside and also on the outside. The bucket is the frame and support for this particular tool bag and there are several variations of this theme. Portable Products (5200 Quincy Street, St. Paul, Minn. 55112-1426) manufactures an assortment of these bags relegated to specific functions. One recent product is the "Bucket Boss 56" which has 56 pockets to store various tools. The "Bucket Boss" configuration is an improvement in that it holds tools vertically with many pockets for different size tools. Selection and accessing of the tools is adequate but once such a tool bag is installed in a bucket and loaded with tools, they are difficult to store or stowaway behind a seat or in the back of a truck. The tools are exposed and often get caught on other objects and are sometimes inadvertently pulled out. If the bucket tips over, everything stored therein can spill out.

SUMMARY OF THE INVENTION

It is an object of the present invention to provide a novel tool bag which overcomes the drawbacks of the commercially available tool bags and boxes.

It is also an object to provide such a tool bag which has a central panel with a handle at its top that allows the tool bag to be easily carried.

Still another object is to provide such a tool bag in which the central panel is covered by tiered fabric pockets allowing for vertical storage and easy accessibility to the stored tools.

A further object is to provide such a tool bag which may be readily and economically fabricated and will enjoy a long life in operation.

It has now been found that the foregoing and related objects can be readily attained in a tool bag for holding, manually transporting and providing easy accessibility to a plurality of workmen tools by a user. The tool bag has a bottom member which defines a flat surface upon which the tool bag can be rested. A central generally rigid panel-like or frame member is centrally located on and attached to the bottom member so as to extend substantially normal thereto and has a handle to be gripped by the user. A fabric body portion is attached to the bottom member and central panel-like member to thereby form at least one enclosure for the workmen tools. The fabric body member is made at least in part from a flexible material chosen from the group consisting of canvas, vinyl, leather, cloth and combinations thereof.

Desirably, the bottom member is a plastic tray to which the central panel-like member and the fabric body member are attached. The central panel-like member can also be made of a plastic material with a rib along at least a part of its periphery. The bottom member can have a pair of centrally located, opposed walls forming a groove dimensionally sized to receive a lower end of the central panel-like member.

According to the invention, the central panel-like member has an opening defined therein adjacent an upper end thereof to form the handle. An ergonomically designed, molded soft rubber-like grip is formed through and adjacent the opening to provide comfort to the user and protection if the tool bag is hung on a hook or door knob.

In still another feature, the fabric body portion is attached to the bottom member along a periphery thereof by stitching and includes a plurality of fabric pocket panels creating pockets adapted to contain assorted workmen tools. The pockets created by the fabric pocket panels are tiered allowing for long tools to be stored in deep pockets formed by a first fabric pocket panel and smaller tools to be stored in pockets formed by the remaining fabric pocket panels. The fabric pocket panels are attached to at least one main fabric panel which is attached to the central panel-like member. The fabric body portion can also include a plurality of dividers creating pockets along the bottom member adapted to contain assorted workmen tools.

Conveniently, the fabric body member includes two cover panels on each side of the central panel-like member so as to provide access to the at least one enclosure for the workmen tools. The cover panels each having a zipper closure member attached thereto.

The invention will be fully understood when reference is made to the following detailed description taken in conjunction with the accompanying drawings.

DETAILED DESCRIPTION OF THE INVENTION

Figure 1:
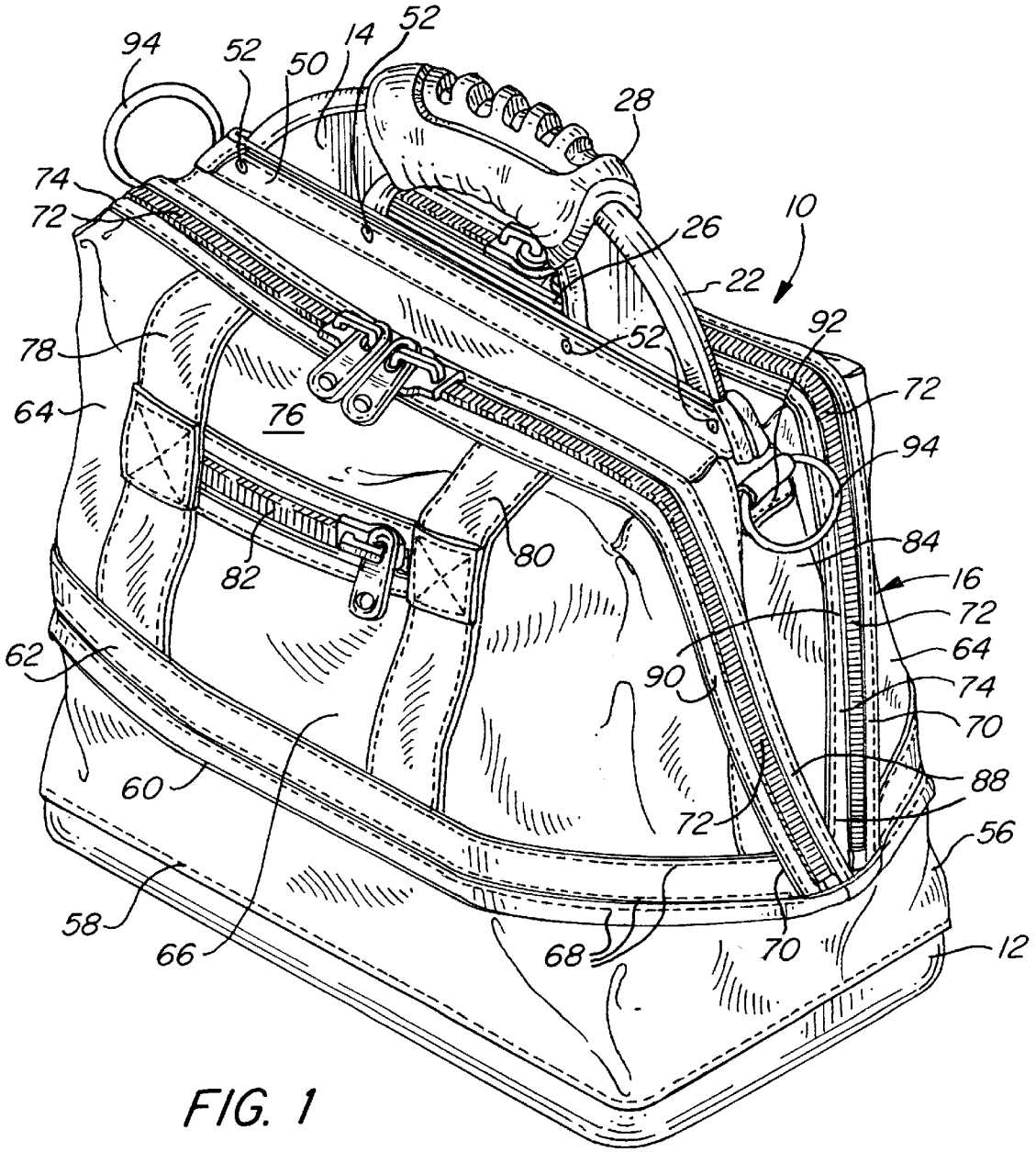
FIG. 1 is a perspective view of the invention.
Figure 2:
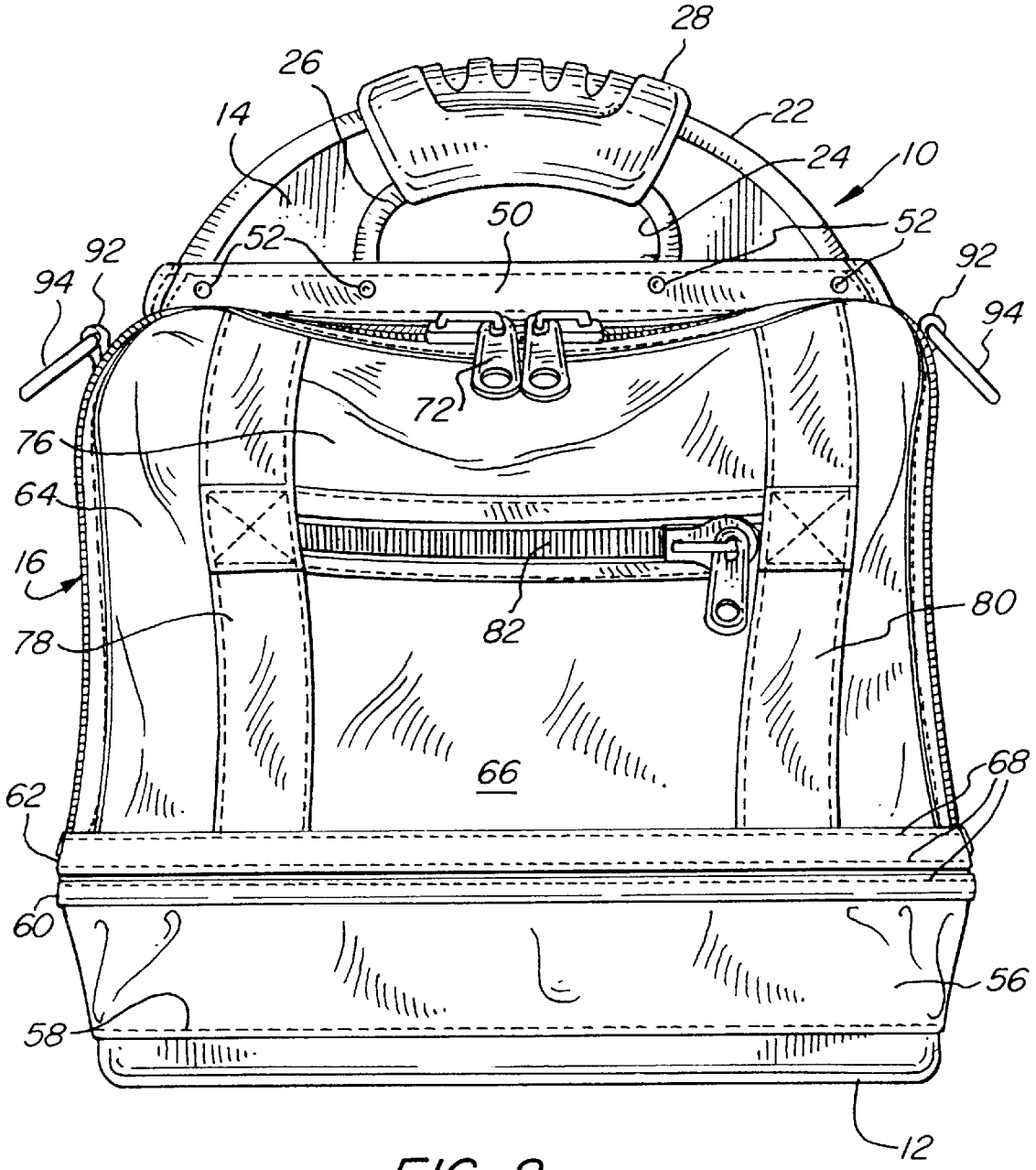
FIG. 2 is a side view of the invention.

With particular reference to FIGS. 1–9, therein is illustrated a tool bag generally designated by the numeral 10 and made in accordance with the present invention. The tool bag 10 comprises a substantially rectangular bottom member 12 having a central panel or frame member 14 extending substantially normal thereto and a fabric body portion generally designated by the numeral 16.

Figure 7:
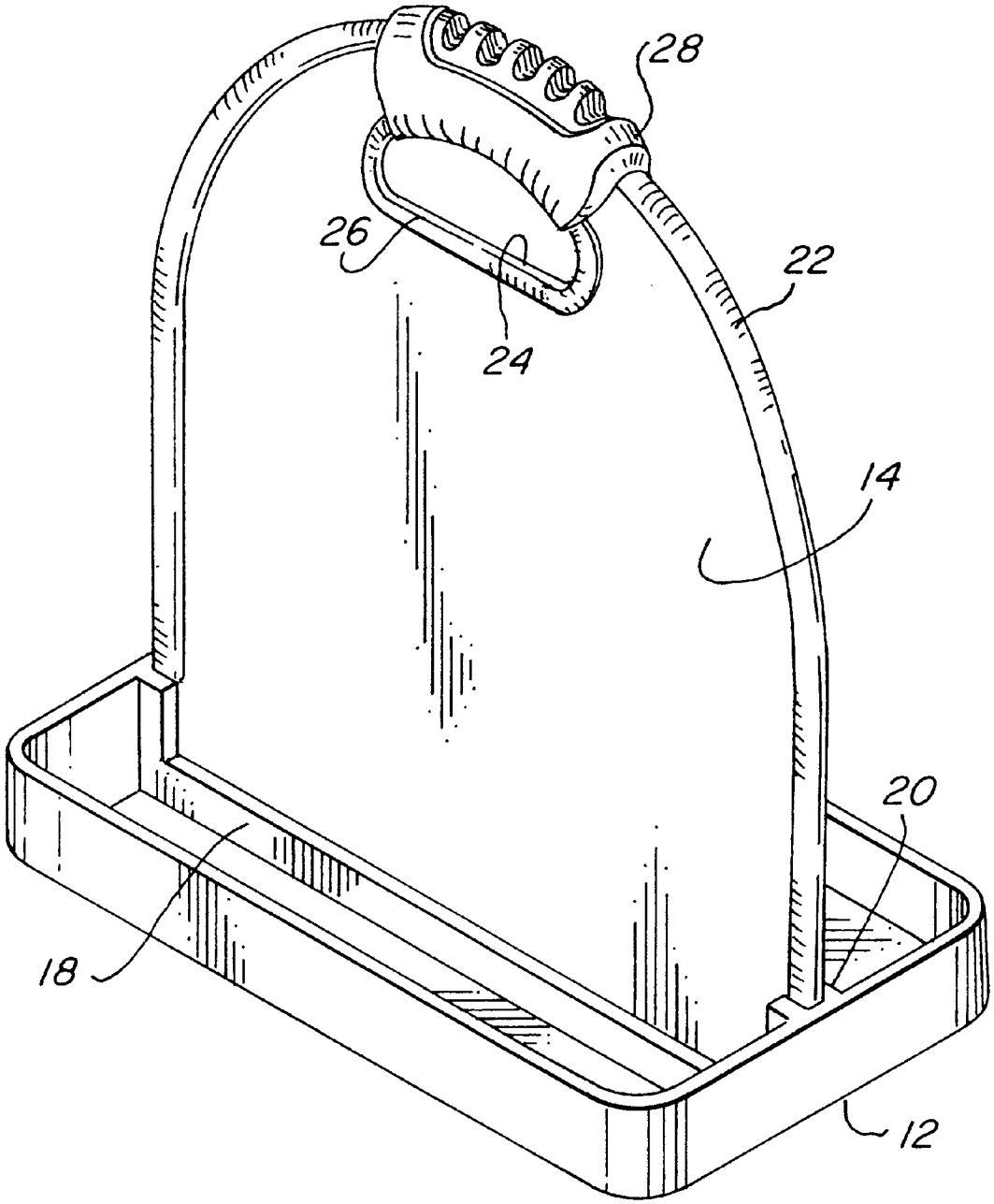
FIG. 7 is a perspective view of the central panel member and bottom member.
Figure 8:
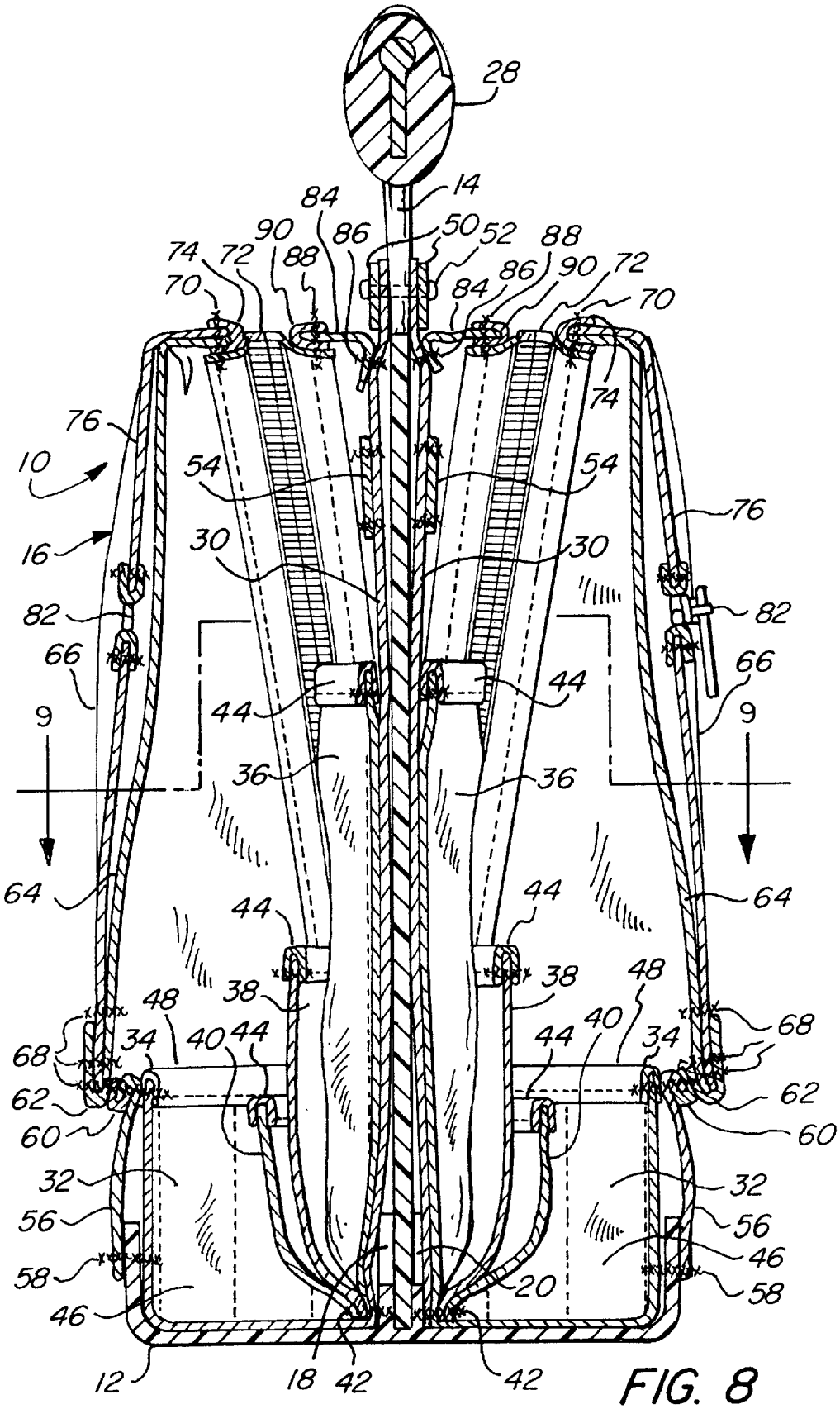
FIG. 8 is a cross-sectional view of the invention along the 8—8 line of FIG. 9.

As seen in FIGS. 7 and 8, the bottom member 12 is formed in the shape of a tray with a pair of centrally located, opposed U-shaped walls 18, 20 forming a groove dimensionally sized to receive the lower end of the central panel member 14. Preferably, the bottom member 12 and central panel member 14 are both constructed of a suitable relatively rigid, impact resistant plastic material. The central panel member 14 is secured to the bottom member 12 in the groove formed by the opposed U-shaped walls 18, 20 by means of adhesive, sonic welding or other suitable means thereby forming the sturdy structural frame for the tool bag 10. Instead of being formed in two parts which are secured together, the bottom member 12 and central panel member 14 could also be integrally formed by injection molding and thus formed would not need the U-shaped walls 18, 20.

As also seen in FIG. 7, the central panel member 14 is curved at its upper portion and has an enlarged rib 22 along its periphery to provide further structural rigidity thereto. The central panel member 14 has an opening 24 defining a handle through which the hand of the user can be inserted. The opening 24 also has an enlarged rib 26. An ergonomically styled, soft molded rubber grip 28 is formed through and adjacent the opening 24 to provide comfort to the user and protection if the tool bag 10 is hung on a hook or door knob.

Figure 9:
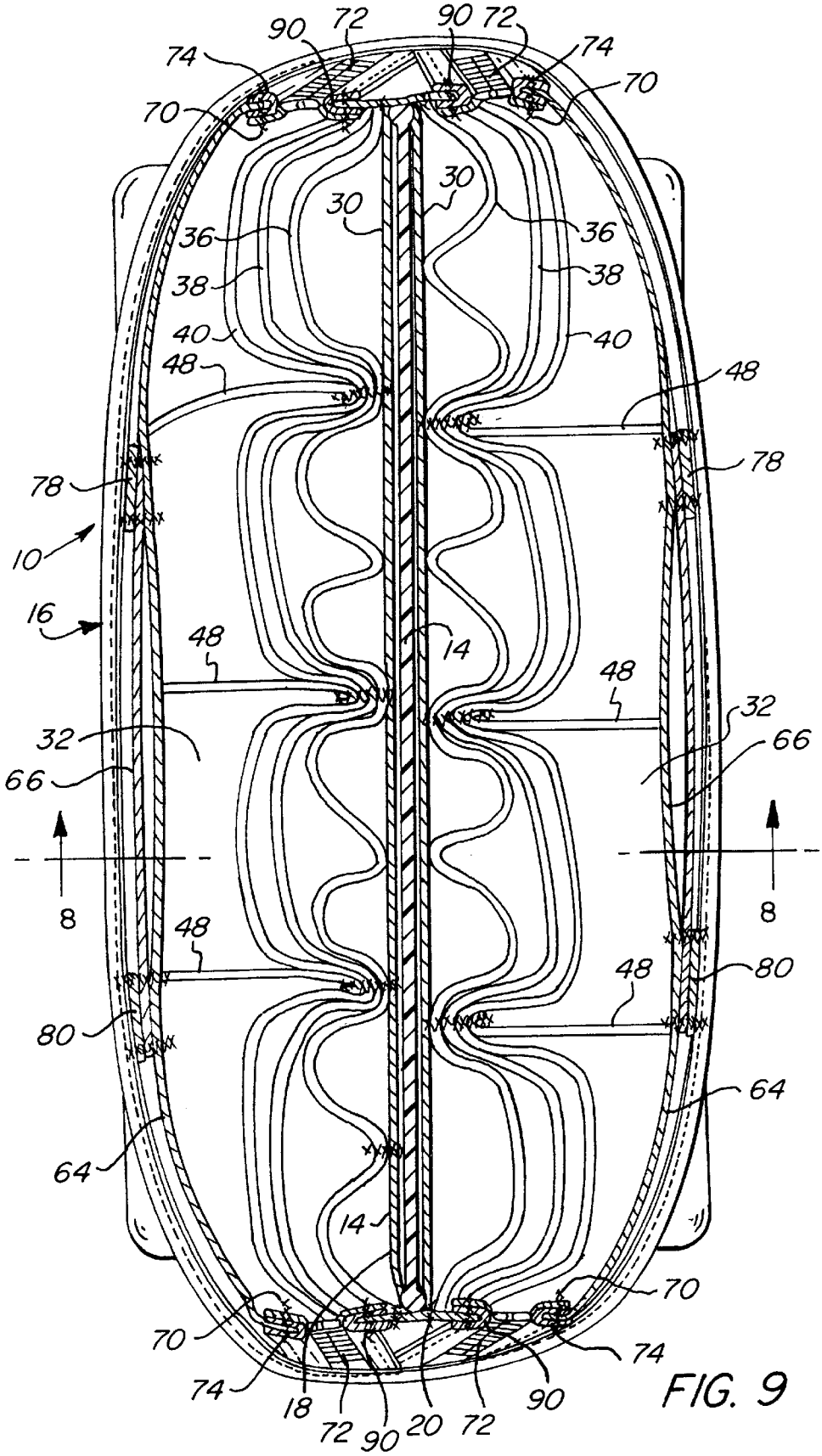
FIG. 9 is a cross-sectional view of the invention along the 9—9 line of FIG. 8.

Turning now to FIGS. 8 and 9, the fabric body portion 16 is designed to be attached to the bottom member 12 and central panel member 14. It should be understood that the term "fabric" as used in conjunction with the fabric body portion 16 and any of its components can be any suitable natural or synthetic flexible material such as canvas, vinyl, leather, cloth or combinations thereof. The fabric body portion 16 on each side of the central panel member 14 is identical so its design and construction will be explained with reference to only one side of the central panel member 14. The fabric body portion 16 has a main fabric panel 30 which extends down a side of the central panel member 14, along the inside of the bottom member 12 and upwards to form a lowermost pocket 32. A fabric finishing strip 34 is sewn to a lower edge of the main fabric panel 30 to provide a finished look and long wearing construction thereto. First, second and third fabric pocket panels 36, 38, 40 are stitched to the main fabric panel 30 in an undulating fashion (see FIG. 9) so as to create pockets adapted to contain assorted workmen tools. The main fabric panel 30 and first, second and third fabric pocket panels 36, 38, 40 are stitched to the bottom member 12 as shown by reference numeral 42 and are provided with fabric finishing strips 44 at their upper edges.

Figure 6:
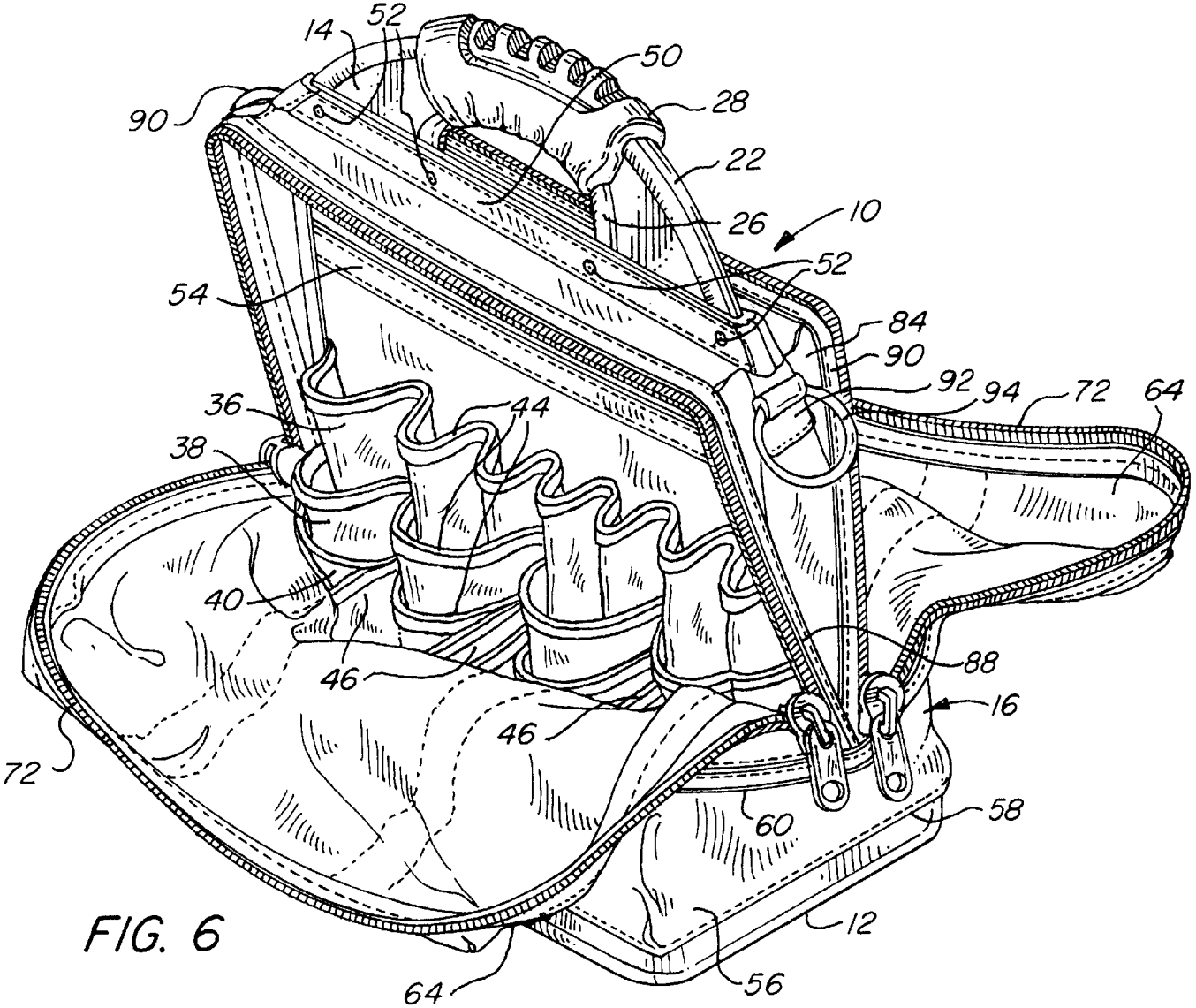
FIG. 6 is a perspective view of the invention in an open position.

It should be noted that the pockets created by the first, second and third fabric pocket panels 36, 38, 40 are tiered allowing for long tools (e.g. chisels, screwdrivers) to be stored in the deep pockets formed by the first fabric pocket panel 36 and smaller tools to be stored in the pockets formed by the second and third fabric pocket panels 38, 40. The tiered configuration of the pockets allows the tools to be stored vertically for easy accessibility. Referring to FIGS. 6, 8 and 9, it should also be noted that three fabric dividers 46 are secured between the main fabric panel 30 and third fabric pocket panel 40 to divide the lowermost pocket 32 adjacent the bottom member 12. Each of the dividers 46 has a fabric finishing strip 48 along the top thereof.

As seen clearly in FIGS. 1 and 8, the top of the main fabric panel 30 has a woven nylon fabric tape 50 therealong. Both the main fabric panel 30 and the woven nylon fabric tape 50 are secured to the central panel member 14 by a plurality of pop rivets 52 but the skilled artisan will appreciate that other suitable attachment means can also be used. An additional woven nylon fabric tape 54 is stitched to the main fabric panel 30 just above the first fabric pocket panel 36 for decorative purposes.

Extending upwardly from and surrounding the bottom member 12 is a bottom fabric portion 56 of the fabric body portion 16. The bottom fabric portion 56 is attached to the periphery of the bottom member 12 by stitching 58 (FIG. 8) which also secures the main fabric panel 30 to the bottom member 12. At the top of the bottom fabric portion 56, the main fabric panel 30 and bottom fabric portion 56 along with fabric finishing strip 60, woven nylon fabric tape 62, fabric cover panel 64 and lower fabric outer panel 66 are all secured to one another by stitching 68. Utilizing stitching 70, the remaining periphery of the fabric cover panel 64 has a zipper closure member 72 and fabric finishing strip 74 attached thereto. As can be best seen in FIGS. 1, 7 and 8, the stitching 70 also secures an upper fabric outer panel 76 and two woven nylon fabric tapes 78, 80 which cooperate with the lower fabric outer panel 66 and a zipper closure member 82 to form a outer accessible pocket centrally located on the fabric cover panel 64.

Figure 3:
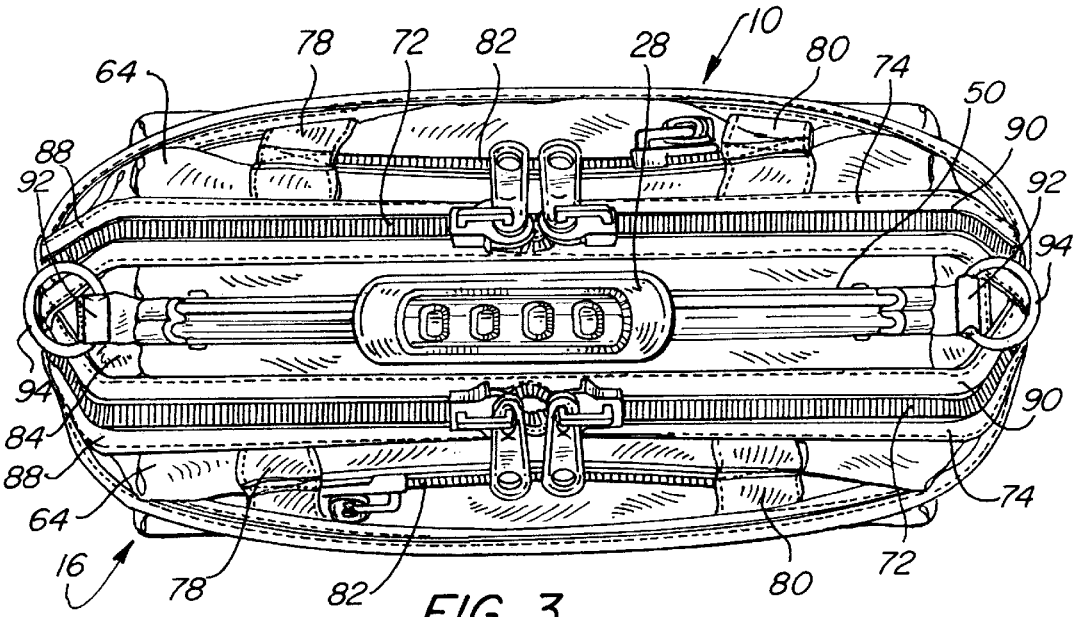
FIG. 3 is a top view of the invention.
Figure 4:
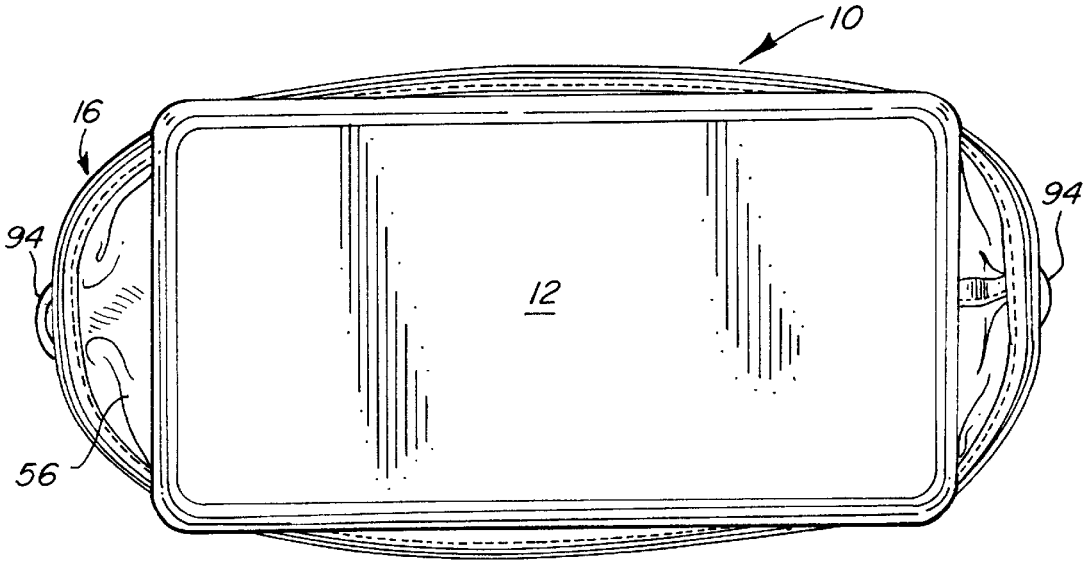
FIG. 4 is a bottom view of the invention.
Figure 5:
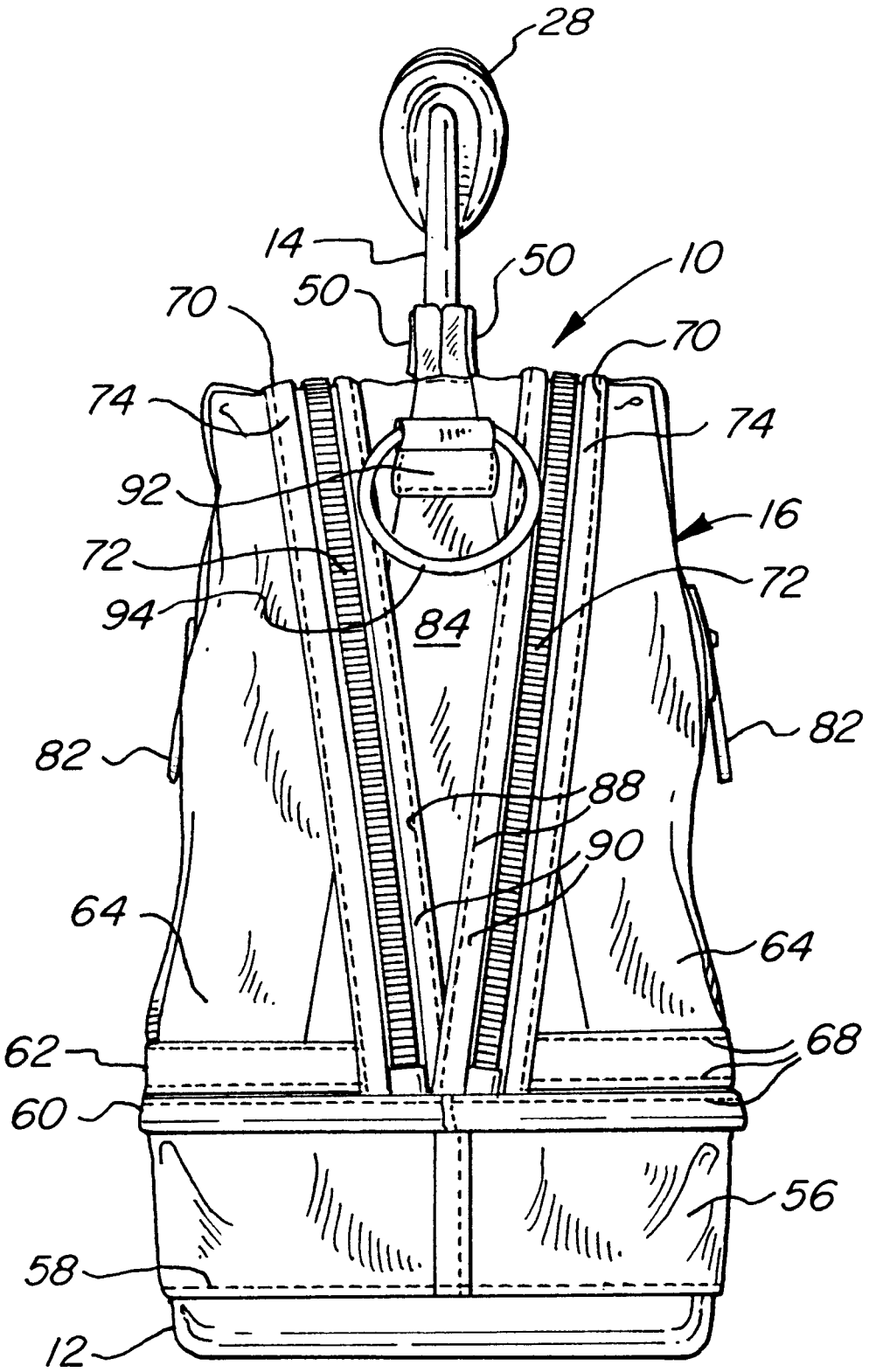
FIG. 5 is an end view of the invention.

As seen most clearly in FIGS. 1, 3 and 8, the fabric body portion 16 is also defined by an elongated, tapering fabric strip portion 84 which is attached by stitching 86, 88 to the main fabric panel 30 and the zipper closure member 72. A fabric finishing strip 90 is also secured by the stitching 88 to the edge of the elongated, tapering fabric strip 84. Attached to the elongated, tapering fabric strip 84 at the ends of the tool bag 10 adjacent the central panel member 14 by means of woven nylon fabric tape 92 are metal loops 94 for securing a detachable carrying strap (not shown) in a well known manner.

In use, the user of the tool bag 10 of the present invention can open the two fabric cover panels 64 by unzipping the zipper closure members 72 thereby providing access to the interior of the tool bag as seen in FIG. 6. Once opened, the various pockets formed by the first, second and third fabric pocket panels 36, 38, 40 and the dividers 46 can be loaded with tools. The tiered configuration of the pockets allows the tools to be stored vertically for easy accessibility. Tools and other smaller items can be also stored in the outer accessible pockets centrally located on the fabric cover panels 64. These outer accessible pockets are entered by use of the zipper closure members 82. Once the tool bag 10 is loaded, the fabric cover panels 64 can be returned to their closed position using the zipper closure members 72 (see FIG. 1). In this closed position, the tools are full enclosed in the tool bag 10 so the tools will not come out of the tool bag 10 during carrying and transport or in the event the tool bag 10 is accidently knocked over once it is laid to rest. The central panel member 14 helps balance the load of tools whereby the tool bag 10 can be easily carried by the user.

Figure 10:
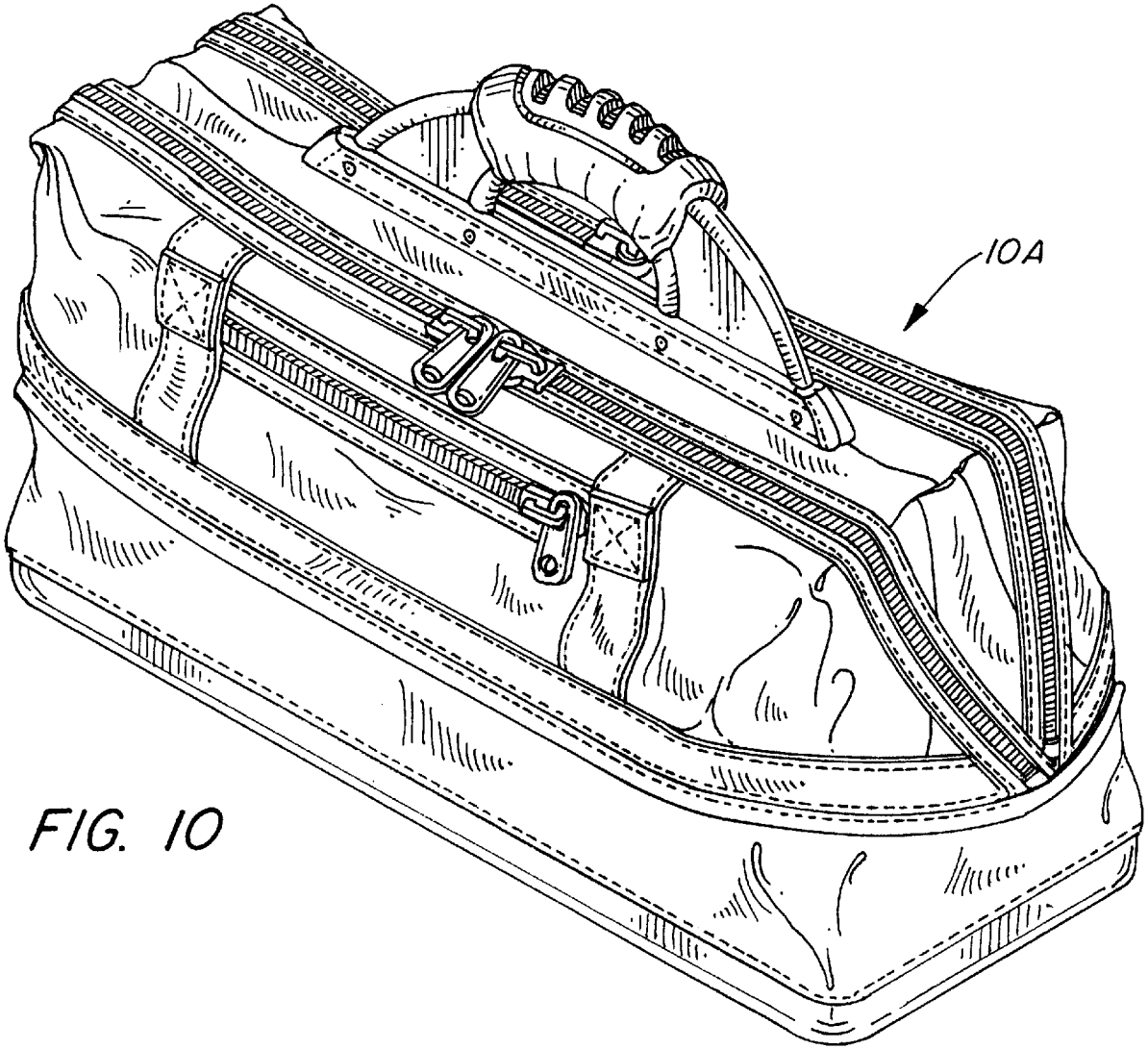
FIG. 10 is a perspective view of a second embodiment of the invention in a closed position.

Turning now to FIG. 10, the second embodiment of the invention generally indicated by the reference numeral 10A is essentially identical to the embodiment shown in FIGS. 1–9 except the relative height and length dimensions are slightly different so tool bag 10A can hold longer tools such as saws and levels. To accommodate the longer tools in the second embodiment, it is desirable not to include the dividers 46 (FIGS. 6, 8 and 9) so the longer tools can be stored within the lowermost pocket 32. It should be noted that metal loops for the carrying are also not included in the second embodiment.

Figure 11:
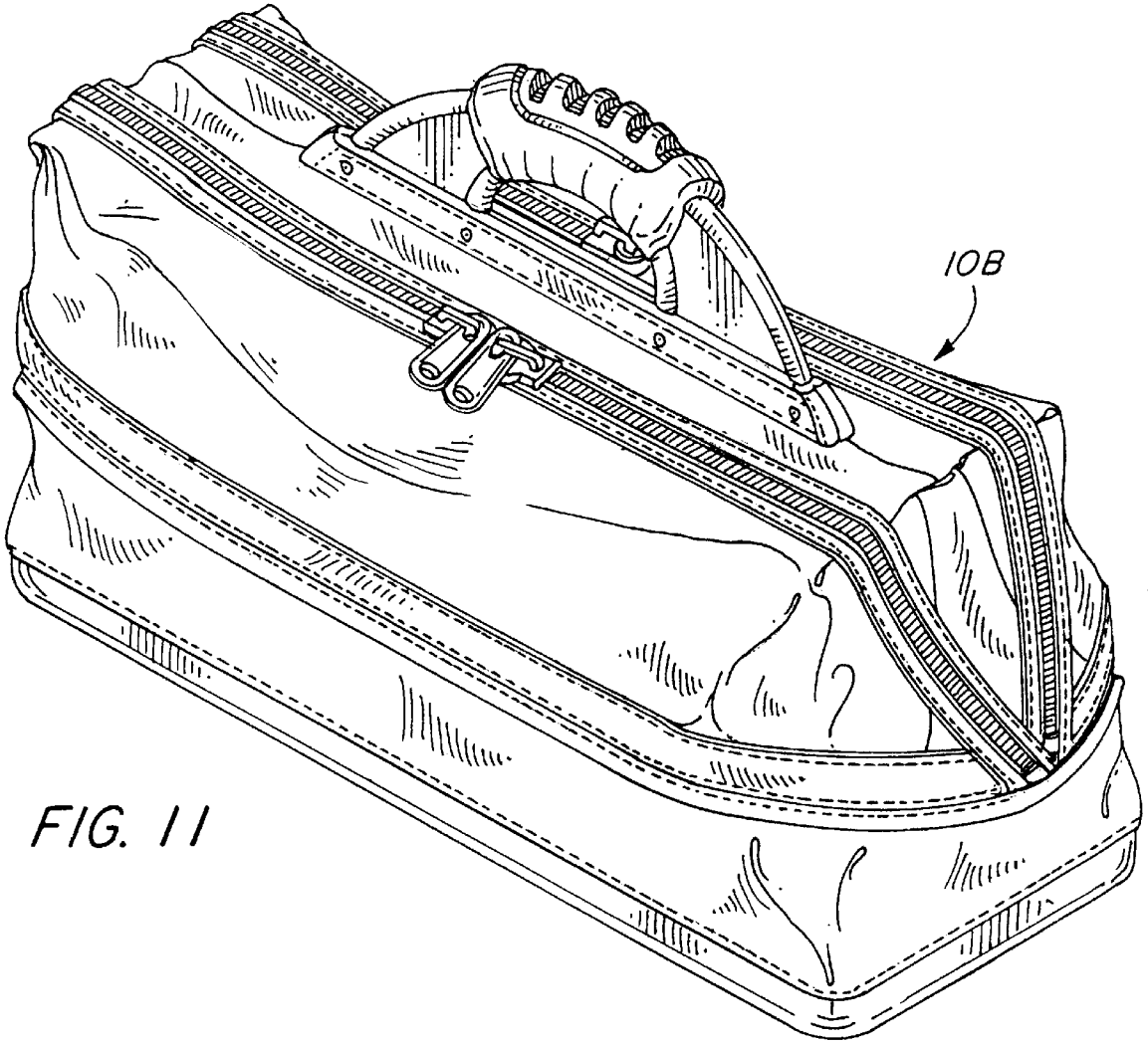
FIG. 11 is a perspective view of a third embodiment of the invention in a closed position.

In FIG. 11, the third embodiment of the invention generally indicated by the reference numeral 10B is essentially identical to the second embodiment of FIG. 10 but does not include the outer accessible pockets on the fabric cover panels.

Thus, it can be seen from the foregoing specification and attached drawings that the tool bag of the present invention provides an effective means for carrying and accessing workmen tools therein. The materials used in the present invention are very durable and, therefore, the tool bag will function adequately for a very long period of time.

It is believed that the many advantages of this invention will now be apparent to those skilled in the art. It will also be apparent that a number of variations and modifications may be made therein without departing from its spirit and scope. Accordingly, the foregoing description is to be construed as illustrative only, rather than limiting. This invention is limited only by the scope of the following claims.

Having thus described the invention, what is claimed is:

1. A tool bag for holding, manually transporting and providing easy accessibility to a plurality of workmen tools by a user, the tool bag comprising:

a bottom member, said bottom member defining a flat surface upon which the tool bag can be rested;

a central, generally rigid panel-like member extending substantially normal to said bottom member and having a handle to be gripped by the user; and a fabric body portion attached to said central, generally rigid panel-like member and thereby forming at least one enclosure for the workmen tools.

2. The tool bag of claim 1, wherein said bottom member comprises a plastic tray to which said central panel-like member and said fabric body member are attached.

3. The tool bag of claim 2, wherein said bottom member has a pair of centrally located, opposed walls forming a groove dimensionally sized to receive a lower end of the central, generally rigid panel-like member.

4. The tool bag of claim 2, wherein said fabric body member is attached to said bottom member by stitching.

5. The tool bag of claim 1, wherein said bottom member and central, generally rigid panel-like member are both made of a plastic material.

6. The tool bag of claim 1, wherein said central, generally rigid panel-like member is attached to said bottom member to extend substantially normal thereto.

7. The tool bag of claim 1, wherein said central, generally rigid panel-like member is made of a plastic material.

8. The tool bag of claim 1, wherein said central, generally rigid panel-like member has an opening defined therein adjacent an upper end thereof to form said handle.

9. The tool bag of claim 8, wherein a grip is formed through and adjacent the opening to provide comfort to the user and protection if the tool bag is hung on a hook or door knob.

10. The tool bag of claim 9, wherein said grip is a ergonomically designed, molded soft rubber-like grip.

11. The tool bag of claim 1, wherein said central, generally rigid panel-like member has a rib along at least a part of its periphery.

12. The tool bag of claim 1, wherein said fabric body portion includes a plurality of fabric pocket panels creating pockets adapted to contain assorted workmen tools.

13. The tool bag of claim 12, wherein said pockets created by said fabric pocket panels are tiered allowing for long tools to be stored in deep pockets formed by a first fabric pocket panel and smaller tools to be stored in pockets formed by the remaining fabric pocket panels.

14. The tool bag of claim 12, wherein said fabric pocket panels are attached to at least one main fabric panel which is attached to said central, generally rigid panel-like member.

15. The tool bag of claim 12, wherein said fabric body portion includes a plurality of dividers creating pockets along said bottom member adapted to contain assorted workmen tools.

16. The tool bag of claim 1, wherein said fabric body portion includes a plurality of dividers creating pockets along said bottom member adapted to contain assorted workmen tools.

17. The tool bag of claim 1, wherein said fabric body member is attached to said bottom member along a periphery thereof.

18. The tool bag of claim 17, wherein said fabric body member is attached to said bottom member by stitching.

19. The tool bag of claim 18, wherein said fabric body member includes at least one cover panel having a closure attached thereto, said at least one cover panel providing access to said at least one enclosure for the workmen tools.

20. The tool bag of claim 19, wherein each said closure is a zipper closure member.

21. The tool bag of claim 20, wherein said fabric body member includes a cover panel on each side of said central, generally rigid panel-like member, said cover panels providing access to said at least one enclosure for the workmen tools.

22. The bag of claim 1, wherein said fabric body member is made at least in part from a flexible material chosen from the group consisting of canvas, vinyl, leather, cloth and combinations thereof.

23. A bag for providing easy manual transport thereof by a user, the bag comprising:

a bottom member, said bottom member defining a flat surface upon which the bag can be rested;

a central generally rigid frame member centrally located on and attached to said bottom member so as to extend substantially normal to said bottom member and having a handle to be gripped by the user; and a fabric body portion attached to said bottom member and said central generally rigid frame member thereby forming at least one enclosure.

24. The bag of claim 23, wherein said bottom member comprises a plastic tray to which said central generally rigid frame member and said fabric body member are attached.

25. The bag of claim 24, wherein said bottom member has a pair of centrally located, opposed walls forming a groove dimensionally sized to receive a lower end of the central generally rigid frame member.

26. The bag of claim 25, wherein said fabric body member is attached to said bottom member by stitching.

27. The bag of claim 23, wherein said bottom member and central generally rigid frame member are both made of a plastic material.

28. The bag of claim 23, wherein said central generally rigid frame member is made of a plastic material.

29. The bag of claim 23, wherein said central generally rigid frame member has an opening defined therein adjacent an upper end thereof to form said handle.

30. The bag of claim 29, wherein a grip is formed through and adjacent the opening to provide comfort to the user and protection if the bag is hung on a hook or door knob.

31. The bag of claim 30, wherein said grip is a ergonomically designed, molded soft rubber-like grip.

32. The bag of claim 23, wherein said central generally rigid frame member has a rib along at least a part of its periphery.

33. The bag of claim 23, wherein said fabric body portion includes a plurality of fabric pocket panels creating pockets.

34. The bag of claim 33, wherein said pockets created by said fabric pocket panels are tiered forming deep pockets by a =first fabric pocket panel and smaller pockets by the remaining fabric pocket panels.

35. The bag of claim 33, wherein said fabric pocket panels are attached to at least one main fabric panel which is attached to said central generally rigid frame member.

36. The bag of claim 33, wherein said fabric body portion includes a plurality of dividers creating pockets along said bottom member.

37. The bag of claim 23, wherein said fabric body portion includes a plurality of dividers creating pockets along said bottom member.

38. The bag of claim 23, wherein said fabric body member is attached to said bottom member along a periphery thereof.

39. The bag of claim 38, wherein said fabric body member is attached to said bottom member by stitching.

40. The bag of claim 23, wherein said fabric body member includes at least one cover panel having a closure attached thereto, said at least one cover panel providing access to said at least one enclosure.

41. The bag of claim 40, wherein each said closure is a zipper closure member.

42. The bag of claim 23, wherein said fabric body member includes a cover panel on each side of said central generally rigid frame member, said cover panels providing access to said at least one enclosure.

43. The bag of claim 23, wherein said fabric body member is made at least in part from a flexible material chosen from the group consisting of canvas, vinyl, leather, cloth and combinations thereof.

44. The tool bag of claim 1, wherein said central, generally rigid panel-like member has an upper end forming said handle.

45. The tool bag of claim 44, wherein said fabric body portion is attached to said central, generally rigid panel-like member across said upper end thereof adjacent said handle and extends downwardly therefrom to join said bottom member.

46. The tool bag of claim 1, wherein said fabric body portion is attached to said central, generally rigid panel-like member across an upper end thereof adjacent said handle and extends downwardly therefrom to join said bottom member.

47. The tool bag of claim 23, wherein said central generally rigid frame member has an upper end forming said handle.

48. The tool bag of claim 47, wherein said fabric body portion is attached to said central generally rigid frame member across said upper end thereof adjacent said handle and extends downwardly therefrom to join said bottom member.

49. The tool bag of claim 23, wherein said fabric body portion is attached to said central generally rigid frame member across an upper end thereof adjacent said handle and extends downwardly therefrom to join said bottom member.

* * * * *